US008616530B2

(12) United States Patent
Ingelfinger et al.

(10) Patent No.: US 8,616,530 B2
(45) Date of Patent: Dec. 31, 2013

(54) METHOD AND APPARATUS FOR REEVING A HOISTING CABLE

(75) Inventors: Wolfgang Ingelfinger, Erlenbach (DE); Ulrich Dörzbach, Heilbronn (DE)

(73) Assignee: Wolffkran AG, Zug (CH)

( * ) Notice: Subject to any disclaimer, the term of this patent is extended or adjusted under 35 U.S.C. 154(b) by 68 days.

(21) Appl. No.: 13/203,593

(22) PCT Filed: Feb. 24, 2010

(86) PCT No.: PCT/EP2010/001134

§ 371 (c)(1), (2), (4) Date: Nov. 3, 2011

(87) PCT Pub. No.: WO2010/097206

PCT Pub. Date: Sep. 2, 2010

(65) Prior Publication Data

US 2012/0061634 A1 Mar. 15, 2012

(30) Foreign Application Priority Data

Feb. 27, 2009 (DE) ..... 10 2009 010 664

(51) Int. Cl.
*B66D 3/08* (2006.01)

(52) U.S. Cl.
USPC ..... 254/393

(58) Field of Classification Search
USPC ..... 254/390, 393, 398, 399, 401, 402, 405
See application file for complete search history.

(56) References Cited

U.S. PATENT DOCUMENTS

| | | | | |
|---|---|---|---|---|
| 1,436,608 | A | 11/1922 | Rodier | |
| 2,973,942 | A | 3/1961 | Schaper | |
| 3,917,334 | A * | 11/1975 | Koster | 294/82.1 |
| 5,451,032 | A * | 9/1995 | Rhoads | 254/399 |
| 6,908,074 | B2 * | 6/2005 | Eiwan | 254/390 |

FOREIGN PATENT DOCUMENTS

| | | |
|---|---|---|
| DE | 3149690 A1 | 6/1983 |
| DE | 3515155 C2 | 10/1986 |
| DE | 603 18 518 | 1/2009 |
| EP | 1 947 051 | 7/2008 |
| GB | 2 176455 | 12/1986 |

OTHER PUBLICATIONS

International Search Report issued in application No. PCT/EP2010/001134 on Jun. 28, 2010.

* cited by examiner

*Primary Examiner* — Emmanuel M Marcelo
*Assistant Examiner* — Angela Caligiuri
(74) *Attorney, Agent, or Firm* — Foley & Lardner LLP

(57) ABSTRACT

The invention relates to a method and to an apparatus for reeving a hoisting cable of a crane, wherein the load to be transported can be suspended from a lower hook block (3), which is held by the hoisting cable (12), from single-loom to double-loom and from double-loom to triple-loom mode, in which an auxiliary cable and/or a chain are utilized such that the weight of the lower hook block causes the hoisting cable to be pulled around the respective roller.

26 Claims, 9 Drawing Sheets

METHOD AND APPARATUS FOR REEVING A HOISTING CABLE

The invention relates to a method for reeving the hoisting cable of a crane from a one-strand operating mode to a two-strand operating mode and from a two-strand operating mode to a three-strand operating mode, and to an apparatus for carrying out this method.

Hoisting cable reeving serves to change the number of strands. Increasing the number of strands reduces the force required, but at the same time the working speeds are also reduced. It is therefore advantageous if the number of strands of the hoisting cable can be changed according to requirements. In particular in the case of luffing cranes, there is a need for a reeving apparatus which permits the number of strands to be changed with only a small number of working steps and a small application of force.

DE 35 15 155 C2 describes a reeving cable pulley block which permits reeving from the 2-strand operating mode to the 4-strand operating mode. This apparatus has a lower block with load-accommodating means. The reeving is carried out by displacement of the height of a cable pulley deflecting block which can be optionally connected into or disconnected from the cable guidance. A disadvantage of this invention is however that it merely provides a coarse selection possibility, and frequently, for example, a one-strand or three-strand operating mode may be desired however owing to the height of the load and the desired working speed. The reeving apparatus described in DE 31 49 690 A1 also has the same disadvantage.

DE 603 18 518 T2 describes an apparatus for changing the number of strands of a pulley tackle for a crane, which apparatus permits the number of strands of the hoisting cable of the pulley tackle to be changed from a pulley tackle with one strand into a pulley tackle with two strands and vice versa, during which change it is not necessary to disassemble the pulley tackle. In this apparatus, the jib must firstly be moved into a horizontal position in order to change the number of strands. Since the lower block is not held by the hoisting cable during the reeving, since the one end of said hoisting cable is detached manually, the lower block has to be secured, which is done by a link which is connected to the jib being attached by means of a bolt. The hoisting cable is provided with "play" and the bolt which connects the hoisting cable at one end via a wedge element to the chain sprocket which is located on the fork tip of the jib shaft is loosened. A connection of the wedge element at the cable end which is now free to the lower block which has through-holes for this purpose is then produced by means of a bolt. With a locked, inwardly curved guide, which bears approximately tangentially against the cable pulley of the lower block, the individual strand of the hoisting cable is led through at the location at which it is removed from the cable pulley to the centre of the upper part of the housing of the pulley tackle on the jib. The apparatus which is described permits only a changeover between a one-strand operating mode and a two-strand operating mode.

SUMMARY

The invention is based on the object of providing alternative methods and apparatuses for reeving, which permit flexible reeving between various strand operating modes and at the same time keep the expenditure of force by the fitter low.

The object is achieved by means of methods and apparatuses for carrying out these methods for reeving the hoisting cable of a crane, in which the load to be transported can be suspended from a lower block which is held by the hoisting cable which is guided over a first jib cable pulley on the jib, from the one-strand operating mode to the two-strand operating mode, wherein in the one-strand operating mode the end of the hoisting cable is detachably connected to the lower block, and wherein in the two-strand operating mode the hoisting cable is guided over a lower block cable pulley which has the lower block, which method comprises the following steps: guidance of an end of an auxiliary cable, which is connected or can be connected by its other end to the end of the hoisting cable, over the lower block cable pulley, guidance of the one end of the auxiliary cable over a second jib cable pulley on the jib, connection of the one end of the auxiliary cable to the lower block, letting down of the lower block, wherein the weight of the lower block causes the end of the hoisting cable which is connected to the auxiliary cable to be pulled around the lower block cable pulley and approach the jib as the lower block is let down further, and connection of the end of the hoisting cable to the jib.

In order to change over from the two-strand operating mode to the three-strand operating mode, the lower block is pulled up, the one end of the chain which is connected by its other end to the end of the hoisting cable is connected to the lower block, and the lower block is let down, wherein the chain becomes tensioned and the weight of the lower block causes the end of the hoisting cable which is connected to the chain to be pulled over a second jib cable pulley.

In one preferred apparatus according to the invention, the other end of the auxiliary cable can be connected or is connected to the end of the hoisting cable via an auxiliary link.

In the text which follows, the method according to the invention together with the apparatuses for carrying out the methods for use on a crane are described. Various embodiments of the invention are described without this being intended to restrict the invention to these embodiments. The essence of the invention would continue to apply if, for example, details of the shape of the individual components were to be changed, for example the side walls of the lower block.

Wherever the term "connects" is used within the scope of the description of the present invention, this means not only the direct attachment of one component to another but can also relate to indirect attachment of two parts to one another by means of intermediate elements, for example auxiliary links.

Firstly there will be a description of the reeving from the one-strand operating mode to the two-strand operating mode:

In the one-strand operating mode, the hoisting cable which is attached to the jib is led around the first jib cable pulley and connected to the lower block.

In one preferred embodiment of the invention, the lower block of the apparatus has a lower block reeving hook which in the one-strand operating mode is suspended in a detachable fashion from an axle which is connected to the end of the hoisting cable. The hoisting cable is preferably connected to the axle by means of a wedge socket.

The axle is preferably essentially parallel to the rotational axis of the lower block cable pulley.

In the one-strand operating mode the connection of the lower block reeving hook to the axle is preferably secured by means of an axle securing device.

For the purpose of reeving from the one-strand operating mode to the two-strand operating mode, the one end of the auxiliary cable which is connected by its other end to the end of the hoisting cable is guided over the lower block cable pulley. The auxiliary cable is preferably thinner and less rigid than the hoisting cable, with the result that one end of the auxiliary cable can easily be guided, i.e. without a large amount of effort, over the lower block cable pulley. The one end of the auxiliary cable can hang out loosely from the lower block. As far as necessary, the lower block can be pulled up. The auxiliary cable is subsequently guided over a second jib cable pulley and then back to the lower block, where the one end of the auxiliary cable is connected to the lower block. This connection of the one end of the auxiliary cable to the lower block is preferably made on the side of the lower block from which the opening of the lower block reeving hook is turned away in the one-strand operating mode.

The connection of the other end of the auxiliary cable to the end of the hoisting cable is preferably done by attachment to an auxiliary link which is seated on the axle in which the lower block reeving hook engages. The other end of the auxiliary cable can be attached via a drilled through-hole in the auxiliary link through which a shackle, which is seated at one of the ends of the auxiliary cable, is guided.

The auxiliary cable is preferably guided in such a way that in a side view onto the lower block with a circular view of the lower block cable pulley, in which the auxiliary cable runs on the axle of the cable pulley lower block, located to the left of the perpendicularly with respect to the cable pulley, to the cable pulley jib, the auxiliary cable also runs up to the left of the cable pulley jib, and then runs on in the clockwise direction. The auxiliary cable is then guided back to the lower block where its second end is connected to the circular-segment element on the lower block which can be present in the form of a circular segment which is divided into spokes, and this can also be done by a drilled through-hole in the circular arc of the circular-segment element at a suitable location or drilled through-hole in a metal element which is fitted onto the latter, wherein this second auxiliary cable end can also be fastened to the attachment facility by means of a shackle.

The axle securing device on the reeving hook of the lower block is then removed, making it possible from now on for the axle in which the reeving hook engages and which the hoisting cable, which is connected, if appropriate, to the axle and therefore also to the auxiliary link via a wedge socket, to be pulled out of the opening in the reeving hook. If the lower block is then let down, the auxiliary cable is increasingly tensioned. As soon as it is fully tensioned, further lowering of the lower block has the effect, in one preferred embodiment, that the lower block reeving hook is rotated through approximately 40° in the clockwise direction. In this context, the auxiliary link with the axle and the wedge socket with the hoisting cable are pulled around the lower block cable pulley and migrate ever further around the lower block cable pulley as the lower block is progressively let down, and therefore approach the components which are intended to form a connection between the hoisting cable which is pulled around the lower block and the jib.

This part of the apparatus can be constructed in such a way that a wedge socket is connected to the jib, and a swirl catcher, to which the hoisting cable end is to be attached, is seated between them. One preferred embodiment of the apparatus according to the invention for reeving provides such a swirl catcher via which the hoisting cable end is connected to the jib; however, it also corresponds to the essence of the invention if the swirl catcher is dispensed with.

If the lower block is then let further down, the auxiliary link, which is connected to the hoisting cable in the one-strand operating mode via a wedge socket, approaches to an ever greater extent the attachment apparatus which is provided for the other end of the hoisting cable on the jib. In addition to the swirl catcher of a preferred embodiment, this apparatus can also comprise intermediate links and a likewise described wedge socket for attaching the hoisting cable. In this context, such an intermediate link does not, however, have to be configured in the shape shown in the figures of the present document; instead, other connection possibilities, for example intermediate elements of a wide variety of shapes, are also conceivable.

The connection between the auxiliary link to a part of the attachment apparatus on the jib, for example to the swirl catcher, can be made by pushing in a connecting bolt, for which purpose the swirl catcher and the auxiliary link which is connected to the hoisting cable end from the 1-strand operating mode, have to be located sufficiently close to one another.

According to the method of the invention, the auxiliary cable is preferably detached from the lower block after the completion of the connection of the end of the hoisting cable to the jib. As a result, an action range which is as wide as possible is made possible for the crane with respect to the raising and the lowering of the load by means of a vertical movement of the lower block, that is to say by means of the movement of the pulley tackle. Pulling up the lower block for this purpose relieves the load on the auxiliary cable, with the result that the latter is subsequently detached at the attachment points and can be particularly easily removed with the lowering of the lower block.

An apparatus which also permits the reeving from the two-strand operating mode into the three-strand operating mode preferably has the configuration described above. In the two-strand operating mode, the connection between the end of the hoisting cable and the jib in one preferred embodiment of the apparatus is formed by virtue of the fact that an axle which is connected to the end of the hoisting cable and which is essentially parallel to the rotational axis of the second jib cable pulley is held by a jib reeving hook which is arranged on the jib.

This jib reeving hook is preferably part of a circular-segment element which is mounted so as to be rotatable about the rotational axis of the second jib cable pulley.

In the two-strand operating mode, the connection of the jib reeving hook to the axle which the reeving hook engages around is preferably secured by an axle securing device.

It is expedient, and therefore a preferred embodiment, if the end of the hoisting cable is connected to the axle on the jib via an auxiliary link.

The end of the hoisting cable is also connected, in one preferred embodiment, to that axle via a swirl catcher for an apparatus which can be reeved from the two-strand operating mode to the three-strand operating mode, however particularly for an apparatus which permits a changeover between the one-strand operating mode, two-strand operating mode and three-strand operating mode.

In addition, for the reeving from the two-strand operating mode into the three-strand operating mode, a chain element is provided, one end of which is to be connected to the lower block. In one preferred embodiment of the invention, the other end of the chain is also connected to the axle around which the reeving hook engages in the two-strand operating mode.

The chain is preferably guided by the circular-segment element above the second jib cable pulley at the time at which the one end of the chain is connected to the lower block. This can be facilitated by virtue of the fact that part of the circular-segment element is a piece of sheet metal which runs at a certain distance from the cable running face of the second jib cable pulley, parallel or approximately parallel to said cable running face.

An axle is preferably provided at that end of the chain which is to be connected to the lower block.

If it is desired to reeve the hoisting cable from the two-strand operating mode into the three-strand operating mode, the lower block must firstly be pulled up, in which case it is to be ensured that the freely rotating eyelet of the swirl catcher points in the same direction as the fixed eyelet of the swirl catcher. The reeving is done by virtue of the fact that the chain with the axle is hooked into the lower block reeving hook and the connection is secured by closing the axle securing device. The axle securing device on the jib reeving hook is then also removed.

When the lower block is now slowly let down, the chain becomes tensioned. The jib reeving hook, an auxiliary link which is preferably present, with the axle which the reeving hook can at first still engage around further, a swirl catcher which is preferably present, an intermediate link which is preferably present and a wedge socket which is preferably present, is used to attach the hoisting cable and has the hoisting cable suspended therefrom can be rotated by means of a second jib cable pulley.

Starting from the point at which the chain becomes tensioned, the circular-segment element preferably rotates along with the chain about the axle on which said circular-segment element is seated and which is preferably the axle on which the second jib cable pulley is seated, to such an extent that the hoisting cable can position itself on the second jib cable pulley.

In addition to the described circular-segment element which can have the jib reeving hook as a partial element, a further circular-segment element with cable protection can be additionally seated on the jib axle, which circular-segment element is configured in one preferred embodiment in a very similar way to the first circular-segment element, and in this context is configured in the manner of a spoke in order to save weight.

After the circular-segment elements have been clearly rotated, in the way described above, through approximately 180° about the axle on which the second jib cable pulley is mounted, a first guide roller of the circular-segment element, one part of which can be the jib reeving hook, preferably abuts against the hoisting cable, as a result of which the jib reeving hook is held, with the result that the articulated element from the axle which connects the auxiliary link jib and the chain can be removed from the opening in the reeving hook by virtue of the fact that the axle slides out of this opening. In this context, a guide roller is understood to be a piece of material, preferably made of metal, in the form of a bolt, preferably cylindrical, which is pushed through the circular-segment element, transversely with respect to the running face of the cable pulley and perpendicularly with respect to the circular-segment element.

The first circular-segment element therefore preferably rotates along with the chain about the axle only to such an extent that a first guide roller which is arranged on the circular-segment element impacts against the hoisting cable and the axle subsequently slides out of the opening of the jib reeving hook.

The first guide roller which is arranged on the circular-segment element is then preferably removed, with the result that the circular-segment element can rotate further, with the result that elements located between the axle which connects the chain and the hoisting cable and the end of the hoisting cable are not impeded by the circular-segment element. In this way, swirl catchers, an auxiliary link and a wedge socket can be moved past the jib reeving hook.

It is expedient, if the hoisting cable lies in the second jib cable pulley, to provide a cable protection in the second circular-segment element which is then located in the upper region of the second jib cable pulley.

The lower block can then be let down in order to attach an additional weight; the changeover from the two-strand operating mode into the three-strand operating mode has taken place.

BRIEF DESCRIPTION OF THE DRAWINGS

The invention is explained further by the following description of the attached drawings in which exemplary embodiments of the apparatuses and a number of steps in the reeving process are represented by way of example, the drawings 1 to 9 showing the following.

DETAILED DESCRIPTION

Figure 4:
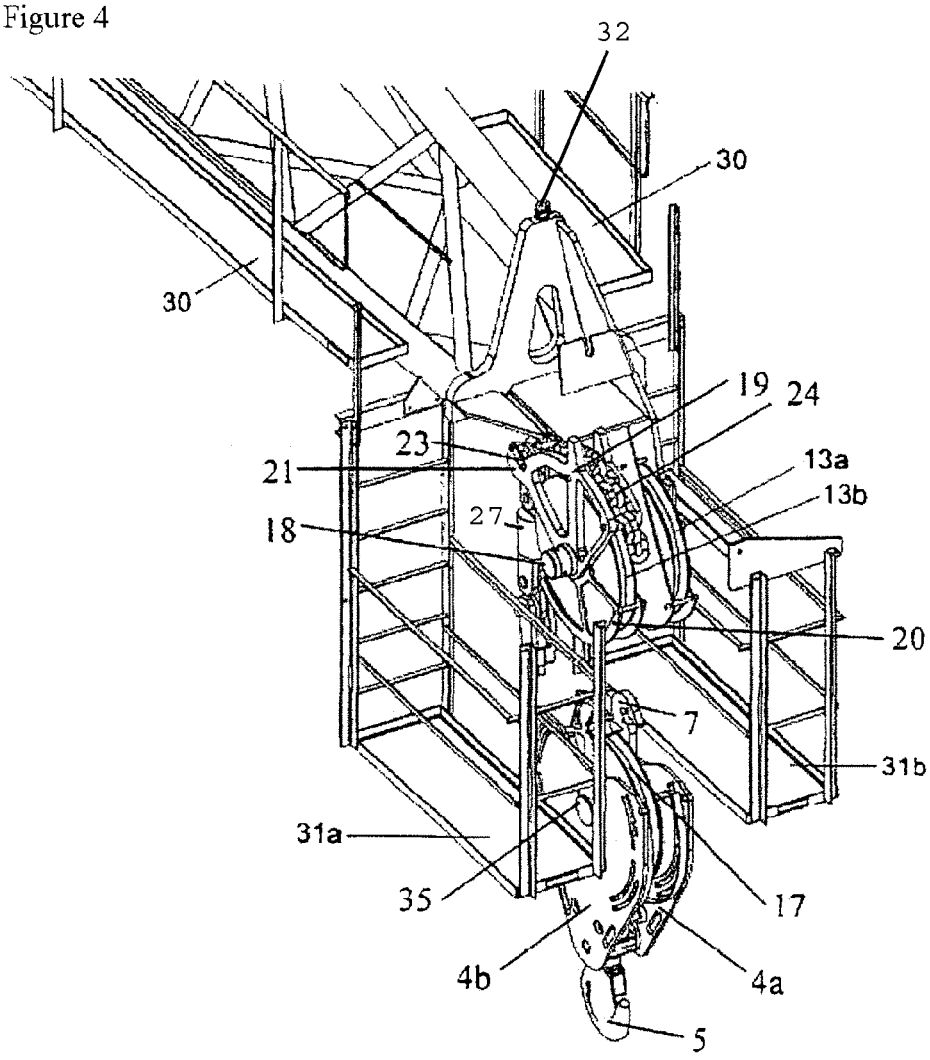
FIG. 4 shows a perspective view of a jib head which shows the first and second jib cable pulleys and a lower block.

FIG. 4 shows a perspective view of a jib head (2) of a crane, which jib head (2) has a first jib cable pulley (13*a*) and a second jib cable pulley (13*b*). The other figures each show a side view, so that in the other figures the first jib cable pulley (13*a*) is concealed by the second jib cable pulley (13*b*). The hoisting cable is guided over the first jib cable pulley (13*a*) in all the strand operating modes (one-strand, two-strand, three-strand). A gangway (30) and two baskets (31*a*, 31*b*) for the fitter lead to the jib head. An attachment facility (32) for the fitter is also provided for the purpose of securement.

Figure 1:
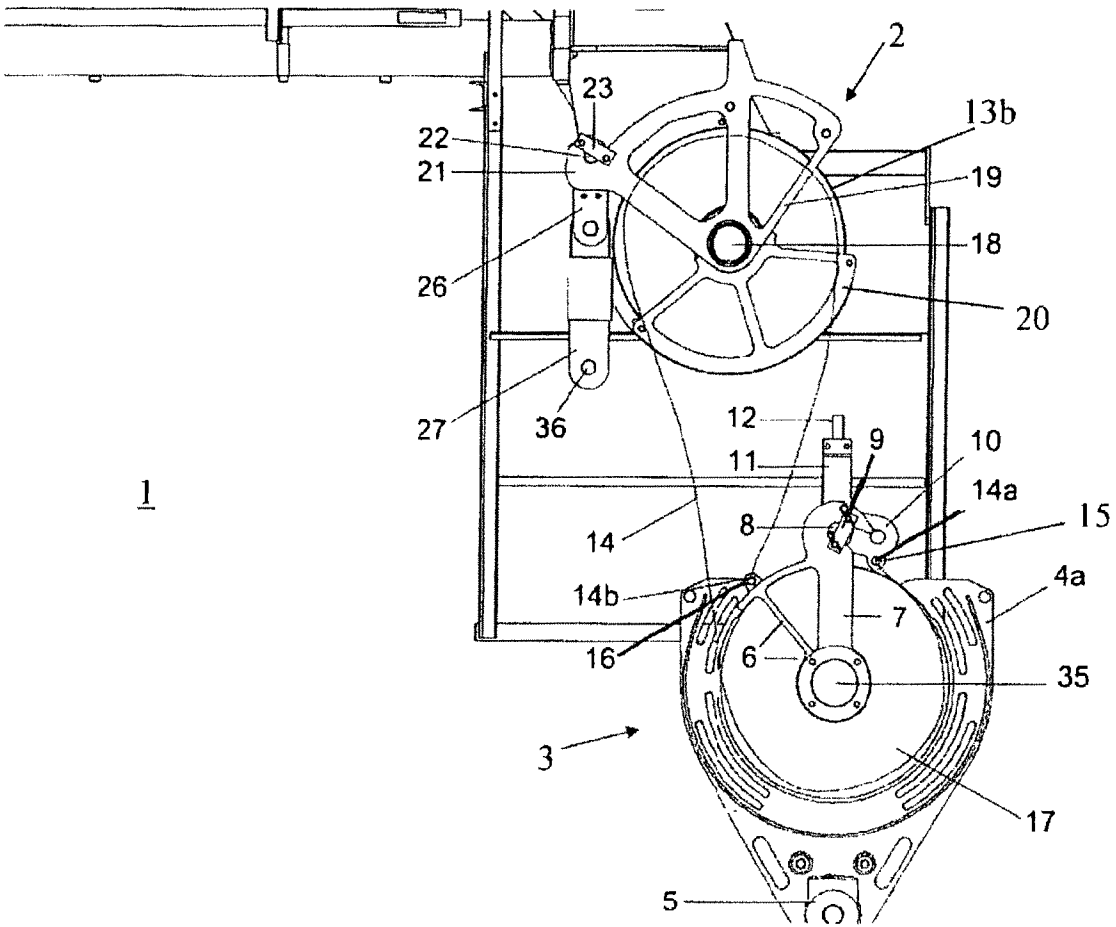
FIG. 1 shows a side view of the jib head and lower block of a crane during the reeving from the one-strand operating mode to the two-strand operating mode, with the complete profile of the hoisting cable strand being omitted but with the profile of the auxiliary cable shown.
Figure 2:
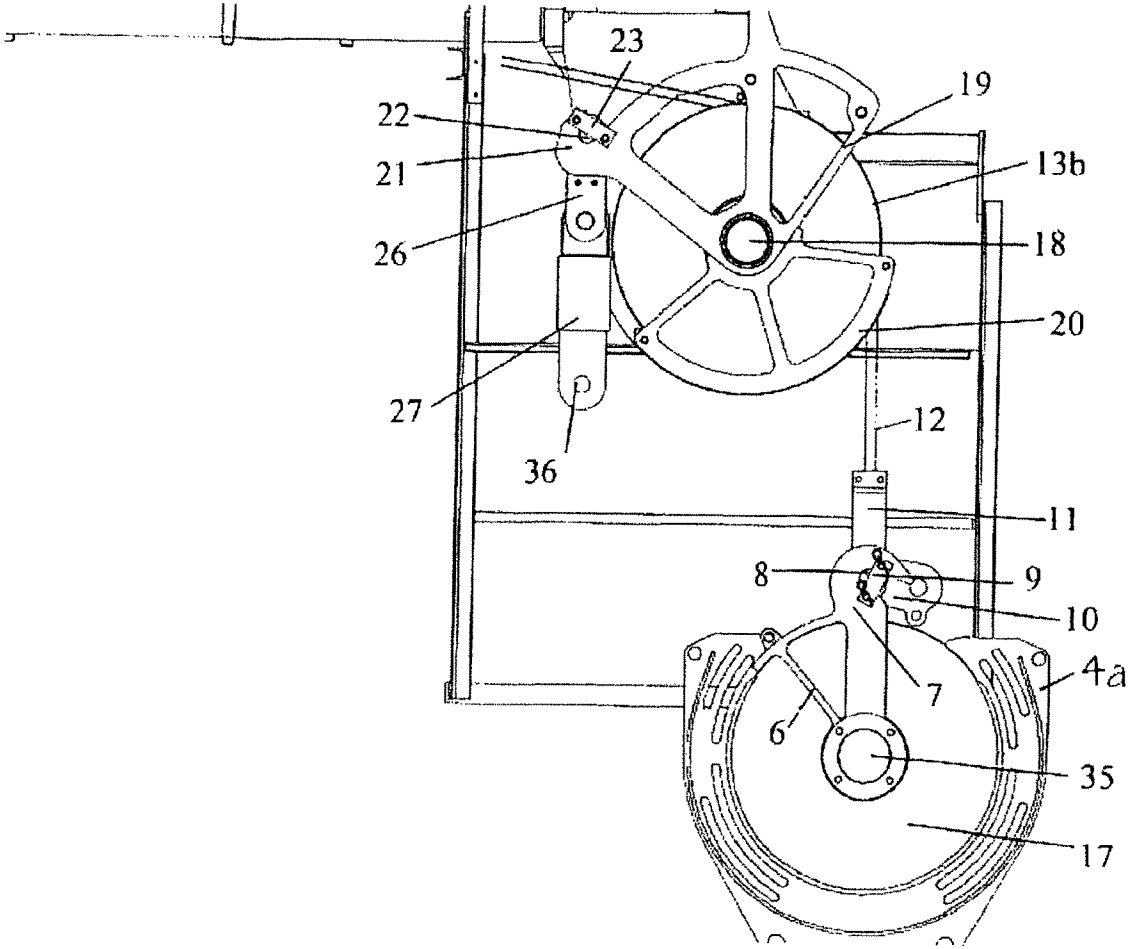
FIG. 2 shows a side view of the pair of deflection pulleys which are mounted on the jib, with the hoisting cable shown in the 1-strand operating mode.

FIG. 1 shows a side view of a jib head of a crane and of a lower block (3) during the method for reeving from a one-strand operating mode to a two-strand operating mode. In the present case this comprises the lower block cable pulley (17), the side walls of the lower block (4*a*, 4*b*), the hook (5), which is mounted at the bottom on the lower block (3) and from which the load is suspended, and a lower block reeving hook (7) which is part of a circular-segment element (6). Furthermore, the lower block reeving hook (7) engages in an axle (8) which is secured to the lower block reeving hook (7) by a detachable axle securing device (9). This axle is connected to an auxiliary link (10) and to a wedge socket (11) which produces the connection to the hoisting cable (12). As is shown by FIG. 2, in the one-strand operating mode the hoisting cable (12) forms at this point the only connection between the jib head (2) and the lower block (3). In the present figure, the front side wall (4*b*) of the lower block (3) is omitted in order to permit other components of the lower block (3) to be seen. The hoisting cable has not been completely illustrated in the figure. The auxiliary cable (14) is connected by its one end (14*b*) to the lower block (3) and by its other end (14*a*) to the end of the hoisting cable (12) via an auxiliary link (10). The auxiliary cable runs around the lower block cable pulley (17) and around a jib cable pulley.

Figure 5:
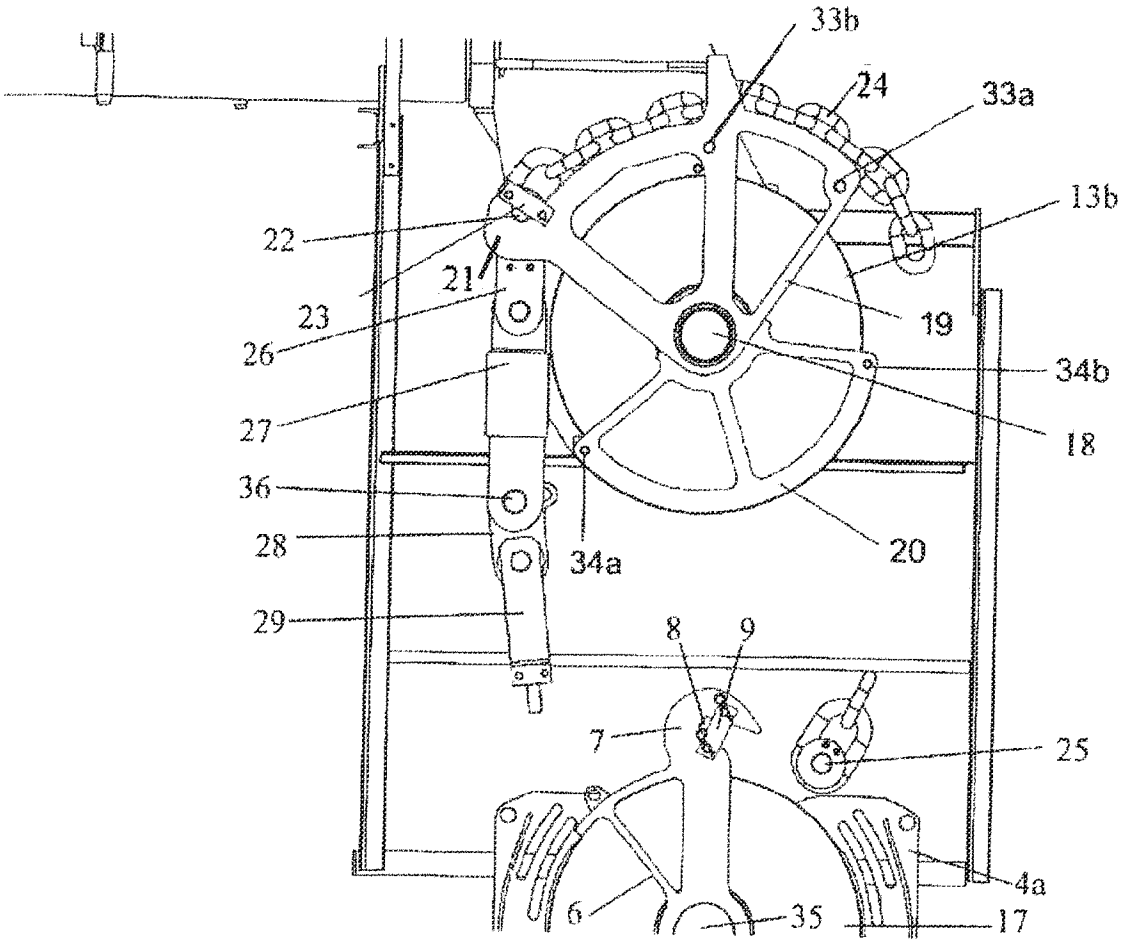
FIG. 5 shows a side view in the state before the (partially shown) chain is connected to the lower block for the reeving from the two-strand operating mode into the three-strand operating mode.
Figure 6:
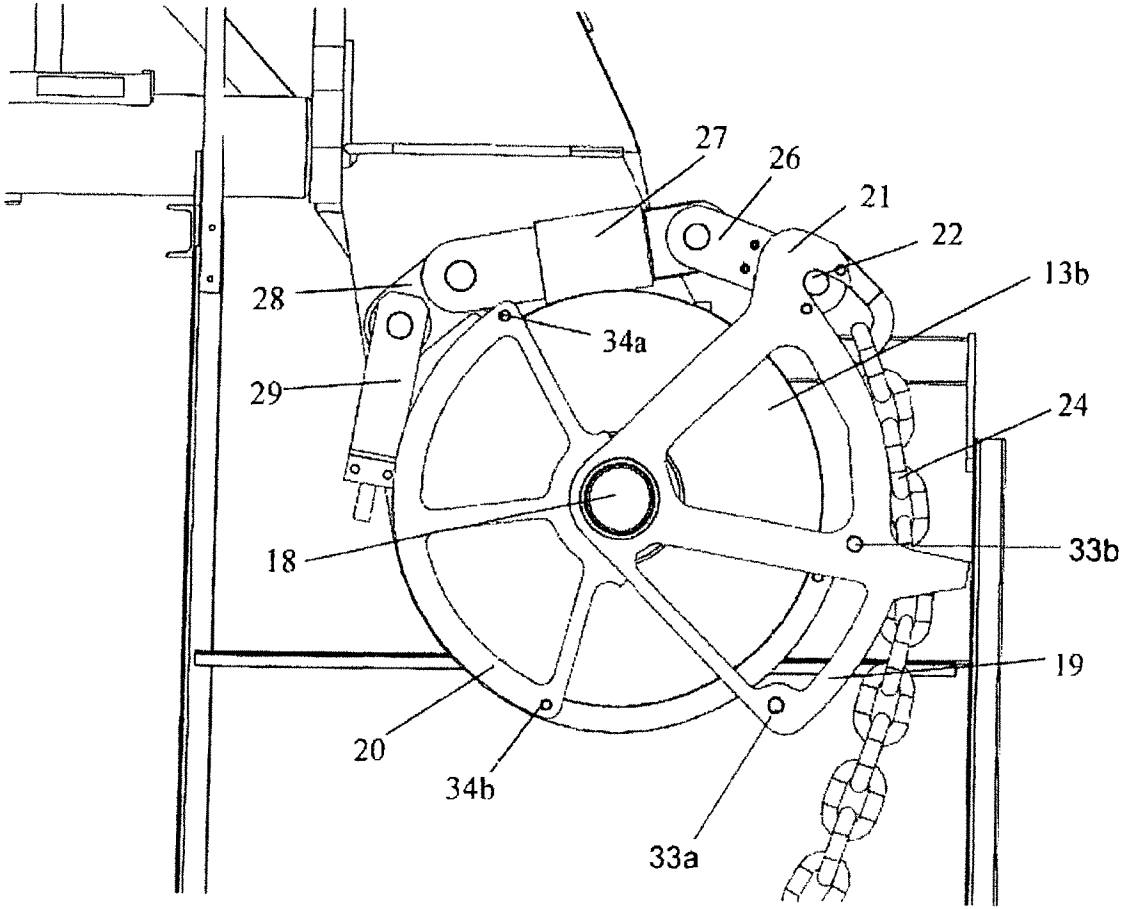
FIG. 6 shows a side view of the jib cable pulley with a released reeving hook after a right-handed rotation of the cable pulley through approximately 100° with respect to FIG. 5.
Figure 7:
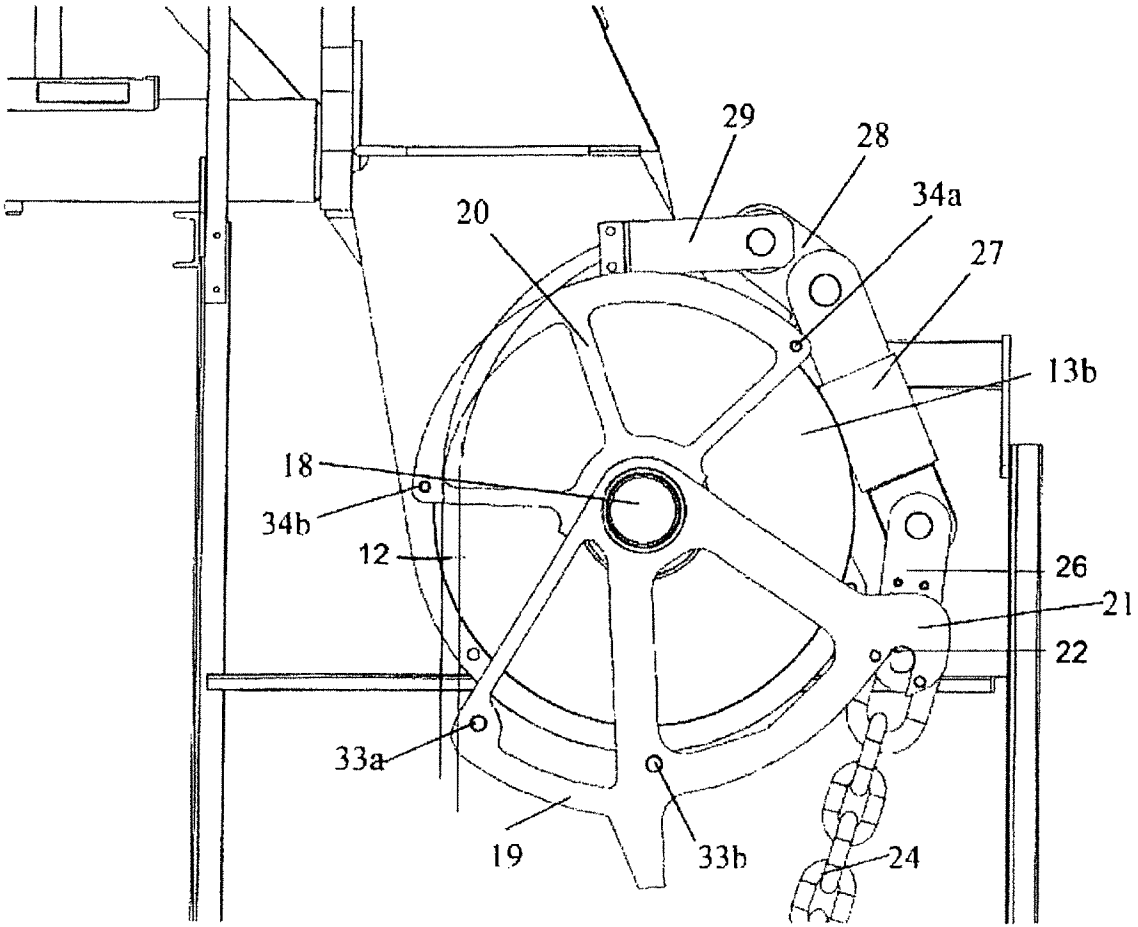
FIG. 7 shows a side view of the jib cable pulley with a released reeving hook after continued right-handed rotation compared to FIG. 5, the point being reached at which the guide roller abuts against the one strand of the hoisting cable.
Figure 8:
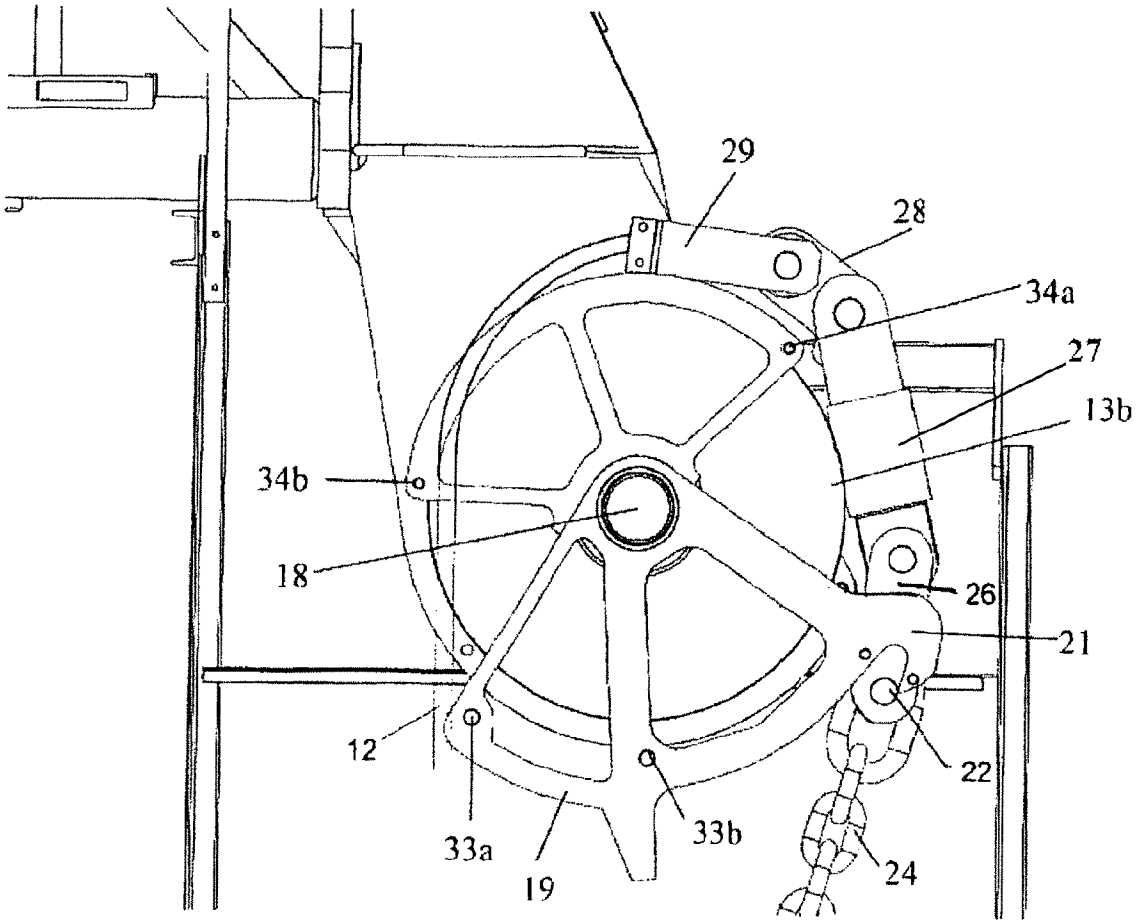
FIG. 8 shows a side view of the jib cable pulley, the auxiliary link sliding away from the jib reeving hook.
Figure 9:
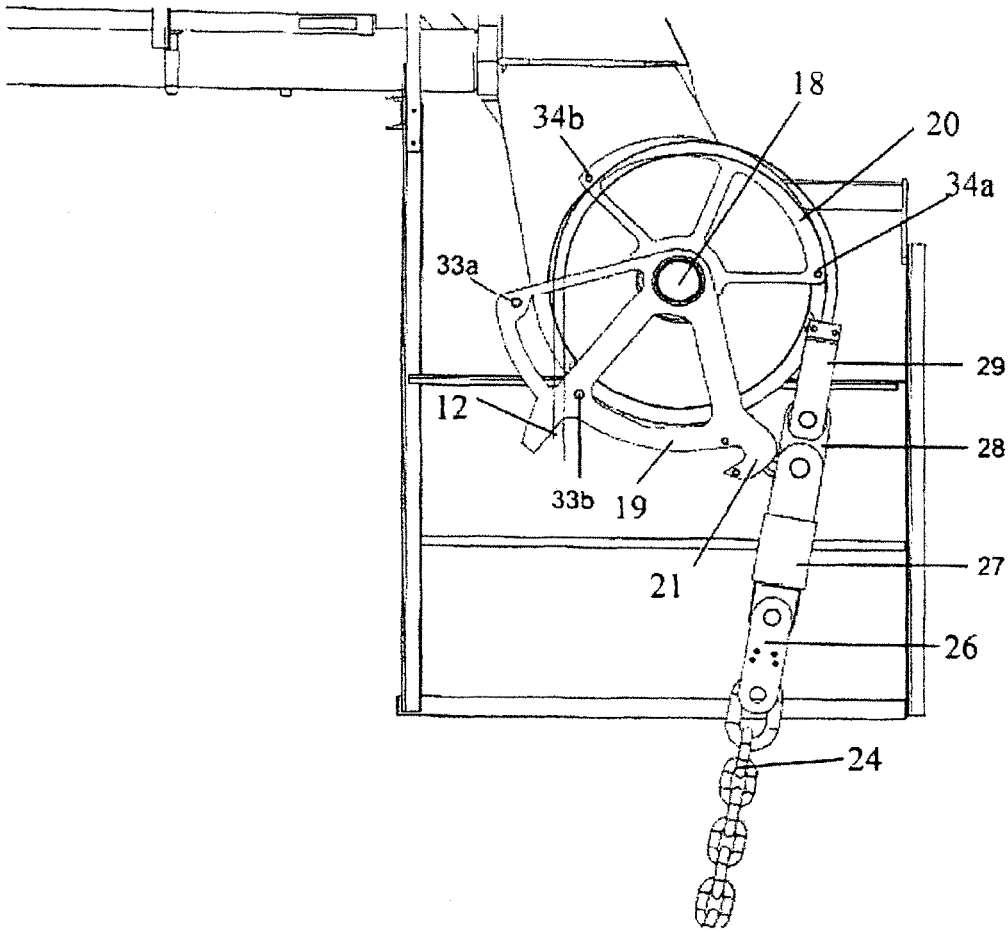
FIG. 9 shows a side view of the jib cable pulley, the joint of the chain to the axle serving to connect to the lower block.

The jib cable pulley is seated on an axle (18) on which a first (19) and a second (20) circular-segment element are also seated. The first circular-segment element (19) is partially formed from the jib reeving hook (21) which engages in an axle (22) to which it is initially secured by a closed axle securing device (23). FIGS. 4 and 5 show that in addition a chain segment (24), whose end has an axle (25), is attached to this axle (22). A sequence composed of the auxiliary link (26), swirl catcher (27) and intermediate link (28) and wedge socket (29) is also seated, as shown in FIG. 3, on the axle in which the jib reeving hook (21) engages, it being possible to attach the hoisting cable (12) in turn to the end of the wedge socket (29).

Figure 3:
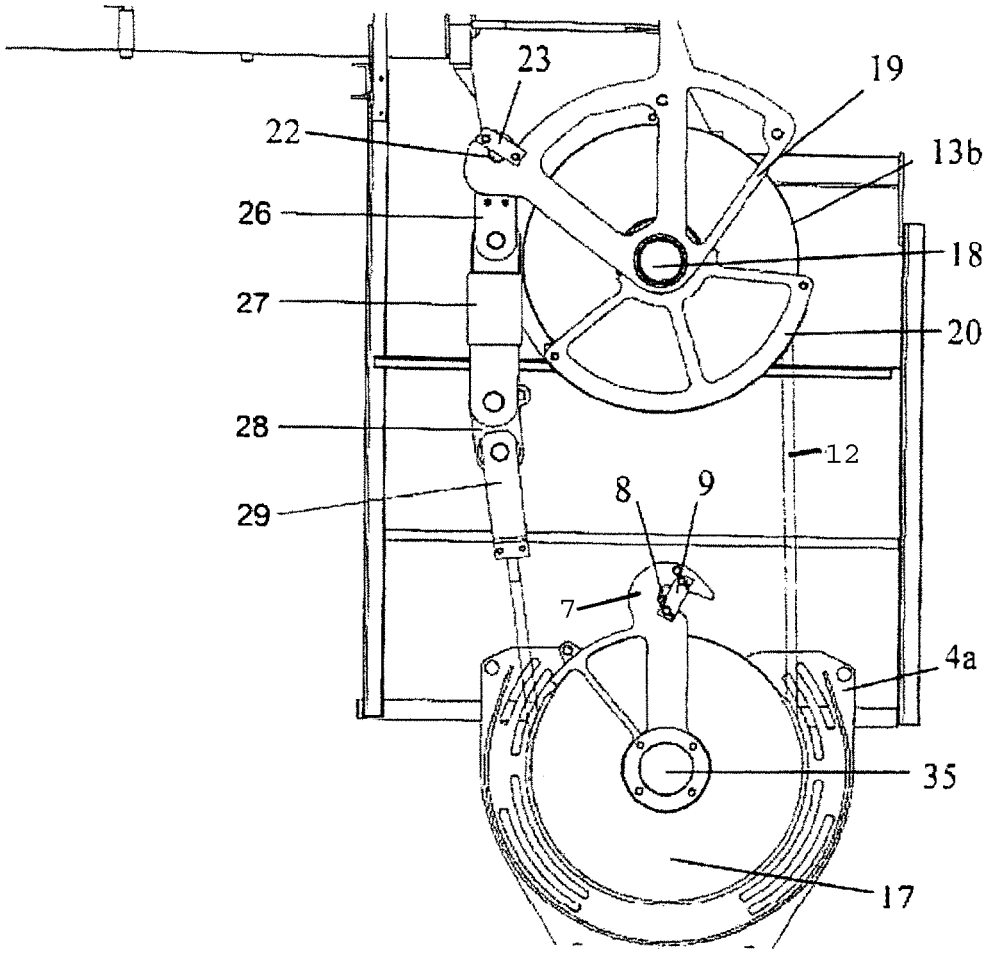
FIG. 3 shows a side view of the pair of deflection pulleys which are mounted on the jib, with the hoisting cable shown in the 2-strand operating mode.

FIGS. 2 and 3 show the apparatus from FIG. 1, with the profile of the hoisting cable (12) being respectively show here, to be precise in the 1-strand operating mode and in the 2-strand operating mode, respectively.

FIGS. 5 to 9 show individual steps when the number of strands is changed from the 2-strand operating mode into the 3-strand operating mode with particular attention being paid to the significant steps which occur at the second jib cable pulley (13*b*). The first (19) and the second (20) circular-segment elements can be clearly seen next to the guidance of the chain (24) over the jib reeving hook (21). The circular-segment element (19) whose significant component is the jib reeving hook (21) is provided with two guide rollers (33*a*, 33*b*). The second circular-segment element (20) has a cable protection (34*a*, 34*b*) at each of its two ends.

LIST OF REFERENCE NUMERALS

1 Apparatus for changing the number of strands of pulley tackle
2 Jib head
3 Lower block
4*a, b* Side walls of the lower block
5 Hook
6 Circular-segment element
7 Lower block reeving hook
8 Axle
9 Axle securing device
10 Auxiliary link
11 Wedge socket
12 Hoisting cable
13*a* First jib cable pulley
13*b* Second jib cable pulley
14 Auxiliary cable
14*a* The other end of the auxiliary cable
14*b* The one end of the auxiliary cable
15 Attachment possibility on the auxiliary link of the lower block
16 Attachment possibility on the circular segment element
17 Lower block cable pulley
18 Axle of the cable pulley on the jib head
19 First circular-segment element on the jib head
20 Second circular-segment element on the jib head
21 Jib reeving hook
22 Axle
23 Axle securing device
24 Chain
25 Axle at end of the chain segment
26 Auxiliary link
27 Swirl catcher
28 Intermediate link
29 Wedge socket
30 Gangway for the fitter
31*a, b* Baskets for the fitter
32 Attachment facility for the fitter
33*a, b* Guide rollers
34*a, b* Cable protection
35 Axle
36 Axle

We claim:

1. A method for reeving a hoisting cable of a crane, in which a lower block is held by the hoisting cable, the lower block being configured to hold a load to be transported that is suspended from the lower block, wherein the hoisting cable is guided over a first jib cable pulley on a jib from a one-strand operating cable mode to a two-strand operating mode, wherein, in the one-strand operating mode, an end of the hoisting cable is detachably connected to the lower block, and wherein, in the two-strand operating mode, the hoisting cable is guided over a lower block cable pulley which has the lower block, wherein said method comprises:

guiding a first end of an auxiliary cable over the lower block cable pulley, a second end of the auxiliary cable being configured to connect to the end of the hoisting cable over the lower block cable pulley, guiding the first end of the auxiliary cable over a second jib cable pulley on the jib, connecting the first end of the auxiliary cable to the lower block, letting down the lower block such that a weight of the lower block causes the end of the hoisting cable which is connected to the auxiliary cable to be pulled around the lower block cable pulley and to approach the jib as the lower block is let down further, and connecting the end of the hoisting cable to the jib.

2. The method as claimed in claim 1, wherein the lower block has a lower block reeving hook which, in the one-strand operating mode, is suspended in a detachable fashion from an axle connected to the end of the hoisting cable.

3. The method as claimed in claim 1, wherein the auxiliary cable is configured to connect by the second end of the auxiliary cable to the end of the hoisting cable via an auxiliary link.

4. The method as claimed in claim 3, wherein the auxiliary link is seated on the axle.

5. The method as claimed in claim 2, wherein, in the one-strand operating mode, connection of the lower block reeving hook to the axle is secured by an axle securing device.

6. The method as claimed in claim 2, wherein a wedge socket is located between the end of the hoisting cable and the axle.

7. The method as claimed in claim 2, wherein the axle is essentially parallel to a rotational axis of the lower block cable pulley.

8. The method as claimed in claim 2, wherein the first end of the auxiliary cable is connected to the lower block on a lower block side, an opening of the lower block reeving hook being turned away from the lower block side in the one-strand operating mode.

9. The method as claimed in claim 1, wherein the end of hoisting cable is connected to the jib via a swirl catcher.

10. The method as claimed in claim 1, wherein after connecting the end of the hoisting cable to the jib, the auxiliary cable is detached from the lower block.

11. A method for reeving a hoisting cable of a crane, in which a lower block is held by the hoisting cable, the lower block being configured to hold a load to be transported that is suspended from the lower block, wherein the hoisting cable is guided over at least one jib cable pulley on a jib from a two-strand operating mode to a three-strand operating mode, wherein, in the two-strand operating mode, the hoisting cable is guided over a first jib cable pulley and an end of the hoisting cable is connected to the jib, wherein said method comprises:

pulling up of the lower block, connecting a first end of a chain to the lower block, the chain being connected by a second end of the chain to the end of the hoisting cable, and letting down the lower block, wherein the chain becomes tensioned and a weight of the lower block causes the end of the hoisting cable which is connected to the chain to be pulled over a second jib cable pulley.

12. The method as claimed in claim 11, wherein, in the two-strand operating mode, connection between the end of the hoisting cable and the jib is formed by an axle which is connected to the end of the hoisting cable and which is essentially parallel to a rotational axis of the second jib cable pulley held by a jib reeving hook which is arranged on the jib.

13. The method as claimed in claim 12, wherein the jib reeving hook is part of a circular-segment element which is mounted so as to be rotatable about the rotational axis of the second jib cable pulley.

14. The method as claimed in claim 12, wherein, in the two-strand operating mode, connection of the jib reeving hook to the axle is secured by an axle securing device.

15. The method as claimed in claim 12, wherein the end of the hoisting cable is connected to the axle via an auxiliary link.

16. The method as claimed in claim 12, wherein the end of the hoisting cable is connected to the axle via a swirl catcher.

17. The method as claimed in claim 12, wherein the other end of the chain is connected to the axle.

18. The method as claimed in claim 13, wherein when the first end of the chain is connected to the lower block, the chain is guided by the circular-segment element above the second jib cable pulley.

19. The method as claimed in claim 18, wherein starting from a point at which the chain becomes tensioned, the circular-segment element rotates along with the chain about the axle to such an extent that the hoisting cable is disposed so as to be positioned on the second jib cable pulley.

20. The method as claimed in claim 19, wherein the circular-segment element rotates along with the chain about the axle to such an extent that a first guide roller which is arranged on the circular-segment element impacts against the hoisting cable, and the axle subsequently slides out of an opening of the jib reeving hook.

21. The method as claimed in claim 19, wherein the first guide roller which is arranged on the circular-segment element is removed so as to permit the circular-segment element to rotate further such that elements located between the axle and the end of the hoisting cable are not impeded by the circular-segment element.

22. The method of claim 1, wherein the hoisting cable is guided over at least one jib cable pulley on the jib from the one-strand operating mode to a three-strand operating mode.

23. An apparatus for reeving a hoisting cable of a crane, the apparatus comprising:

a lower block held by the hoisting cable, the lower block being configured to hold a load to be transported that is suspended from the lower block, wherein the lower block comprises side walls and a lower block cable pulley, the lower block cable pulley having the lower block, a first jib cable pulley over which the hoisting cable is guided on a jib from a one-strand operating mode to a two-strand operating mode, a first axle on which the lower block cable pulley and a first circular-segment element are seated, a lower block reeving hook that is part of the circular-segment element, a second axle in which the lower block reeving hook engages, the second axle being secured to the lower block reeving hook by a detachable first axle securing device, an auxiliary link connected to the second axle and configured to be guided around the lower block cable pulley and around a second jib cable pulley on the jib, wherein the auxiliary cable has a first end configured to connect to the lower block and a second end configured to connect to a first end of the hoisting cable, wherein, in the one-strand operating mode, the end of the hoisting cable is detachably connected to the lower block, wherein, in the two-strand operating mode, the hoisting cable is guided over the lower block cable pulley having the lower block and is configured to connect to the jib, wherein, when the lower block is let down, a weight of the lower block causes the end of the hoisting cable connected to the auxiliary cable to be pulled around the lower block cable pulley and to approach the jib as the lower block is let down further.

24. The method of claim 11, wherein the hoisting cable is guided over the at least one jib cable pulley on the jib from a one-strand operating mode to the three-strand operating mode.

25. The apparatus of claim 23, further comprising:

a third axle on which the second jib cable pulley is seated together with the first jib cable pulley so as to permit transitioning from the two-strand operating mode to a three-strand operating mode, a second circular-segment element, the first circular-segment element and the second circular-segment element being seated on the third axle, and a chain segment attached to the third axle, an end of the chain segment being provided with a fourth axle, wherein the first circular-segment element comprises a jib reeving hook that engages in a fifth axle to which the jib reeving hook is secured by a second axle securing device during the two-strand operating mode.

26. The apparatus of claim 23, further comprising a wedge socket configured to connect the second axle to the hoisting cable such that the second axle is connected to the auxiliary link and to the hoisting cable.

* * * * *